US006537234B1

(12) United States Patent
Komatsu

(10) Patent No.: US 6,537,234 B1
(45) Date of Patent: Mar. 25, 2003

(54) VIBRATION TRANSDUCER

(75) Inventor: Akira Komatsu, Kohto-ku (JP)

(73) Assignee: Acouve Laboratory, Inc., Tokyo (JP)

( * ) Notice: Subject to any disclaimer, the term of this patent is extended or adjusted under 35 U.S.C. 154(b) by 0 days.

(21) Appl. No.: 09/421,409

(22) Filed: Oct. 21, 1999

(30) Foreign Application Priority Data

Oct. 28, 1998 (JP) ..... 10-322847

(51) Int. Cl.[7] ..... A61H 1/00
(52) U.S. Cl. ..... 601/46; 381/396
(58) Field of Search ..... 601/78–82, 46, 601/53, 54, 56–59; 381/413, 301, 396, 151, 152, 326, 398, 425

(56) References Cited

U.S. PATENT DOCUMENTS 4,354,067 A * 10/1982 Yamada et al. ..... 179/146 H
4,710,655 A * 12/1987 Masaki ..... 310/30
RE32,785 E * 11/1988 Hirano ..... 381/194
4,967,871 A * 11/1990 Komatsubara ..... 181/141
5,442,710 A * 8/1995 Komatzu ..... 381/24
5,719,549 A * 2/1998 Lai ..... 340/384.73
5,903,076 A * 5/1999 Suyama ..... 301/81
5,956,622 A * 9/1999 Lee ..... 455/38.2
5,960,096 A * 9/1999 Imahori et al. ..... 381/417
6,141,427 A * 10/2000 Fukuda ..... 381/151
6,151,402 A * 11/2000 Azima et al. ..... 381/396
6,278,787 B1 * 8/2001 Azima ..... 381/152

* cited by examiner

*Primary Examiner*—Justine R. Yu
(74) *Attorney, Agent, or Firm*—Oliff & Berridge, PLC

(57) ABSTRACT

There is provided an electro-mechanical vibration transducer which effectively produces a heavy low vibration. Such a structure is adopted that a yoke is supported in a case of the electro-mechanical vibration transducer by dampers, so that the case and the yoke are relatively displaceable. For the purpose of reducing the load applied to the dampers through vibration at the time of transportation of the transducer, a lock key having a projecting portion is installed to a bottom portion of the case, and the projecting portion is engaged between the yoke and the frame, so that a relative displacement of the yoke is prevented. By the installation of this lock key, defect due to vibration at the time of transportation of products can be prevented from occurring in the products, and the dampers having excellent vibration efficiency can be used, so that a heavy low sound vibration can be sufficiently obtained.

5 Claims, 6 Drawing Sheets

VIBRATION TRANSDUCER

BACKGROUND OF THE INVENTION

1. Field of the Invention

The present invention relates to a structure of an electro-mechanical vibration transducer used as an apparatus for producing a body-sensible sound vibration by an electric signal in a low sound range.

2. Description of the Related Art

A so-called body-sensible sound vibration, such as a vibration feeling felt as vibration of a body by a sound pressure or a vibration feeling felt through a floor surface or the earth, is used not only for audio to increase a heavy low sound feeling but also for an effective sound for, for example, a simulation or virtual reality to enable realistic presence to be reproduced by a documentary sound of an explosion sound, an engine sound, or the like which is accompanied by a vibration feeling or impact feeling. Moreover, its effects are expected in various fields, for example, in application to a music therapy utilizing a relaxation effect by the body-sensible sound vibration, and further, in usage with the object of acceleration of fermentation/maturation of liquor, improvement of quality, etc.

There has been an electro-mechanical vibration transducer, which is an apparatus for producing a body-sensible sound vibration which has been conventionally devised and used.

The electro-mechanical vibration transducer is structured such that a gap is formed between a magnetic pole and a column portion of a yoke, a coil wound around a coil frame is disposed in the gap, and a vibration is obtained by a magnetic interference action produced between a magnetic force generated at the coil by an electric signal and a magnetic force generated at the magnetic pole. In the following, with reference to FIG. 6, an example of a conventional electro-mechanical vibration transducer will be described.

As shown in FIG. 6, a case main body of the electro-mechanical vibration transducer is made up of frames 602 and 603 each having a plate-like section. Plate-like flange portions 604 and 605 extending in the horizontal direction are disposed at opening peripheral portions of the frames 602 and 603, and the frame 602 and the frame 603 are combined by abutting the flange portions 604 and 605 against each other in the state where the opening portions are made opposite to each other.

An outer peripheral fringe 607 of an annular damper 606 (what is formed by boring a plate-like epoxy material) made of an elastic material is held between the flange portions 604 and 605 of the frames 602 and 603, and an inner peripheral fringe 608 of the damper 606 extends horizontally in the direction opposite to the flange portions 604 and 605, that is, the inward direction of the frames 602 and 603.

A yoke 609 disposed in a case main body 601 is made up of a bottom plate 610 having a column portion 611 at its center and an annular top plate 612. An annular magnetic pole 613 is fixed to the bottom plate 610 in the state where it is loosely fitted to the column portion 611. The top plate 612 is attached to the magnetic pole 613, and a magnetic annular gap 616 is formed between an inner fringe 614 of the top plate 612 and an outer fringe 615 of the column portion 611 of the bottom plate 610. A magnetic circuit having the gap 616 is made up of the bottom plate 610, the magnetic pole 613, and the top plate 612.

For the purpose of supporting the yoke 609 in the case main body 601, the inner peripheral fringe 608 of the damper 606 is fixed to a stepped portion 621 formed of an outer fringe of the top plate 612 and an end surface of the magnetic pole 613, and the case main body 601 and the yoke 609 are structured to be relatively displaceable through the damper 606.

An opening 617 is formed at the center portion of the frame 602, a cylindrical coil frame 619 is fixed to the opening 617, that is, the inner peripheral fringe of the frame 602, and a coil 620 wound around the coil frame 619 is disposed in the gap 616. A plate 618 is fixed to the upper surface of the frame 602 so as to cover the opening 617.

In the thus structured electro-mechanical vibration transducer, by applying an electric signal generated by power amplification of a sound signal through a low pass filter to the coil 620, a magnetic interference action produced between a magnetic force generated at the coil 620 and a magnetic force of the magnetic pole 613 causes the yoke 609 supported by the case main body 601 and the case main body 601 to relatively change through the damper 606, so that the body-sensible sound vibration is produced.

However, in the foregoing conventional structure, although it is desired to obtain high oscillation efficiency down to a signal of a further low frequency, stiffness of the damper beyond a certain degree is need to support a heavy yoke, so that the conventional structure is accompanied with difficulty in design to obtain sufficient performance at a low frequency.

Even if the conventional structure has the stiffness of the damper beyond a certain degree to support a heavy yoke, since the case main body and the yoke is always relatively displaceable, the damper can not support the heavy yoke in case where a large load such as vibration or impact is applied at the time of transportation of products, so that defect occurs in the products. In order to avoid this, it is necessary to further stiffen the damper, so that reproduction of a low frequency becomes more difficult, and there has been a defect in performance that it is forced to sacrifice vibration efficiency.

SUMMARY OF THE INVENTION

The present invention has been made in view of the above problem, and an object thereof is to provide an electro-mechanical vibration transducer which provides a lock key for preventing a relative displacement between a case main body and a yoke so that defect due to vibration or impact at the time of transportation of products can be prevented from occurring in the products.

In order to solve the above problem, according to a first aspect of the invention, in an electro-mechanical vibration transducer in which a magnetic gap is formed by a yoke having a magnetic pole, the yoke is supported in a case main body by a damper, a coil is positioned in the gap, and the yoke and the case main body are relatively displaceable, the electro-mechanical vibration transducer is characterized in that a projecting portion of a lock key is inserted between the yoke and the case main body.

According to a second aspect of the invention, in the electro-mechanical vibration transducer of the first aspect, the lock key inserted between the yoke and the case main body is detachably attachable.

According to a third aspect of the invention, in the electro-mechanical vibration transducer of the first or second aspect, the damper includes a plurality of annular dampers each having a different size, the annular dampers are concentrically provided, and the respective dampers are connected to each other through a thin plate connecting portion.

According to a fourth aspect of the invention, in the electro-mechanical vibration transducer of any of the first to third aspects, the damper is made of concentrical-annular dampers connected to adjacent ones or spiral damper, which is a conical shape in a non-load state, and upper end or lower end of the damper is connected to the center of load of the lower surface of the case frame or the yoke concentrically.

DETAILED DESCRIPTION OF THE PREFERRED EMBODIMENTS

Preferred embodiments of an electro-mechanical vibration transducer of the present invention will be described below with reference to the accompanying drawings.

Figure 1:
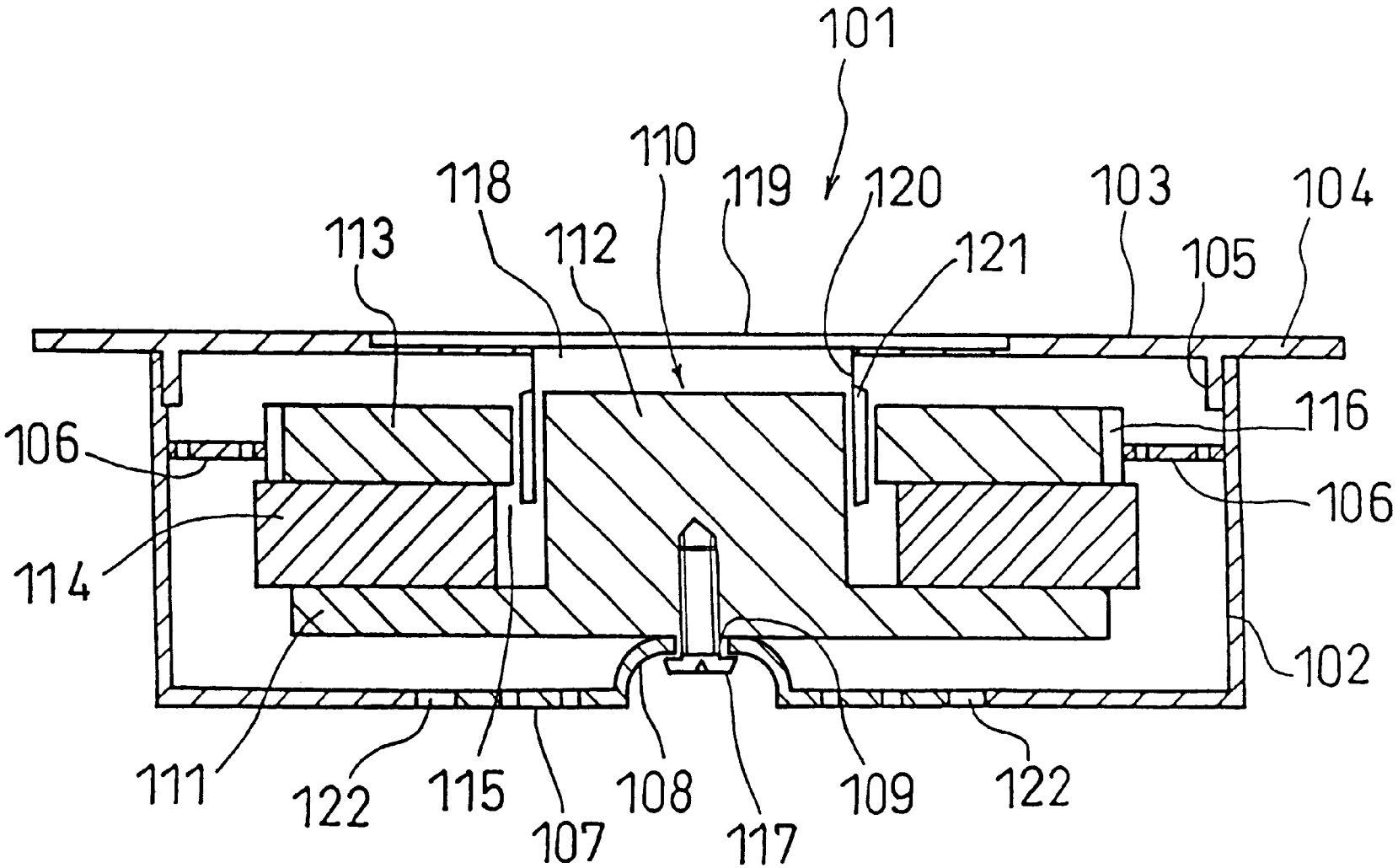
FIG. 1 is a sectional view showing an embodiment of an electro-mechanical vibration transducer of the present invention.

FIG. 1 is a sectional view showing an embodiment of an electro-mechanical vibration transducer of the present invention.

A case main body 101 of the electro-mechanical vibration transducer is made up of a frame 102 and a frame 103. The frame 103 is provided with a cylindrical frame 105 extending in the vertical direction and a plate-like flange portion 104 extending in the horizontal direction at its peripheral portion. The cylindrical frame 105 is fitted to an opening portion of the frame 102, and both the frames are fixed.

An outer peripheral fringe of an annular damper 106 made of an elastic material is fixed to an inside of the frame 102, and an inner peripheral fringe of the damper 106 extends horizontally in an inner direction of the frame 102. A disk-like damper 107 which has a convex portion 108 toward an inside direction of the frame 102 at its center portion and has a screw hole 109 is formed integrally with the frame 102.

A yoke 110 disposed in the case main body 101 is made up of a bottom plate 111 having a column portion 112 at its center and an annular top plate 113. An annular magnetic pole 114 is fixed between the bottom plate 111 and the top plate 113, and a magnetic annular gap 115 is formed between an inner fringe of the top plate 113 and an outer fringe of the column portion 112 of the bottom plate 111. A magnetic circuit is made up of the bottom plate 111 having the column portion 112, the magnetic pole 114, and the top plate 113.

An opening 118 is formed at the center portion of the frame 103, and a cylindrical coil frame 120 attached to a plate 119 is fitted in the opening 118. The coil frame 120 and the plate 119 are fixed to the frame 103, and a coil 121 wound around the coil frame 120 is disposed in the gap 115.

In order to support the yoke 110 in the case main body 101 in the above structure, a cylindrical frame 116 fixed to the outer fringe of the top plate 113 is fixed to the inner peripheral fringe of the damper 106, and the damper 107 is fixed to the bottom plate 111 by a screw 117 through the screw hole 109 provided at the center portion of the damper 107.

By these dampers 106 and 107, such a structure is formed that the case main body 101 and the yoke 110 are relatively displaceable.

An outer peripheral portion of the damper 107 provided at the bottom portion of the case main body 101 is provided with a hole portion 122 in which a projecting portion of a lock key 201 (see FIG. 3), which is installed to prevent the relative displacement between the yoke 110 supported in the case main body and the case main body, is inserted.

Figure 2B:
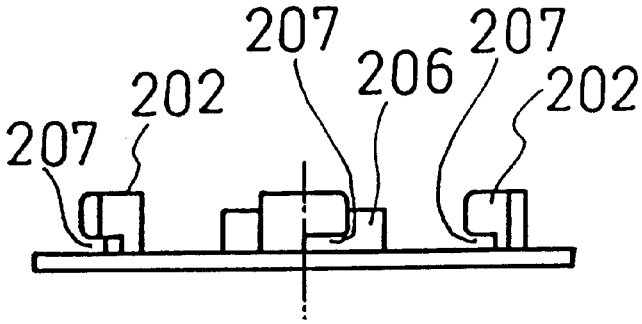
FIG. 2B is a side view of the lock key shown in FIG. 2A.
Figure 2A:
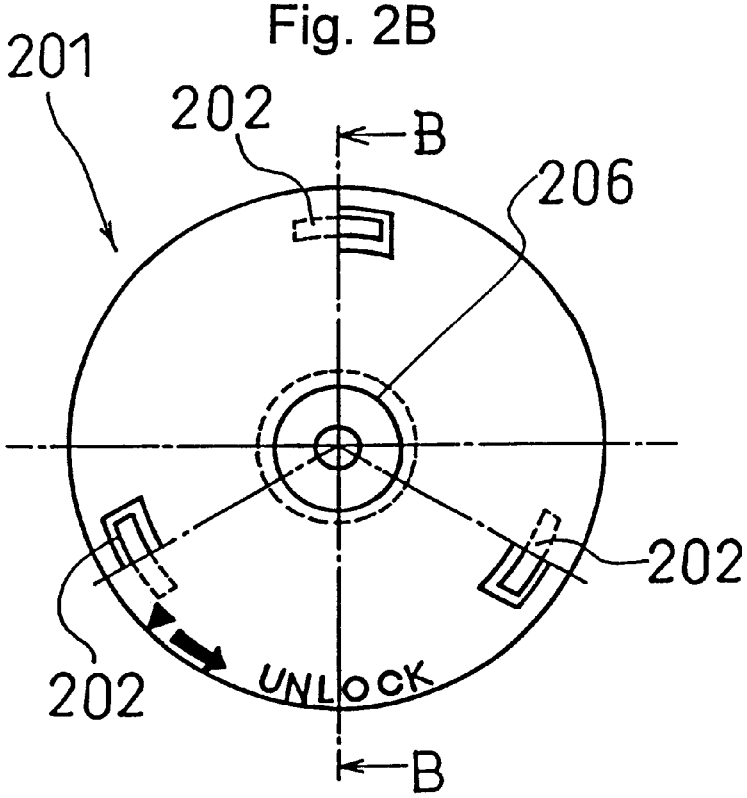
FIG. 2A is a plan view showing an example of a lock key of the electro-mechanical vibration transducer of the invention.
Figure 2C:
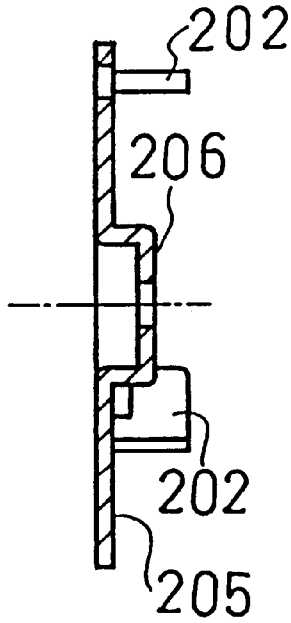
FIG. 2C is a sectional view of the lock key shown in FIG. 2A and taken along line B—B.

Here, the lock key attached to the case main body 101 will be described with reference to FIG. 2.

The lock key 201 is made up of a disk-like plate 205 having a convex portion 206 at its center and a projecting portion 202 provided in the vicinity of an outer peripheral fringe of the plate 205. The projecting portion 202 is made to have a key shape which is locked only when it is rotated in one direction. In the case where a plurality of projecting portions are provided, the projecting portions of all the key shape portions are arranged in the same direction so that they are locked by rotation in one direction. A screw hole 203 for installation to the case main body 101 is provided at the center portion of the convex portion 206. Although the projecting portions 202 provided on the plate 205 are provided at three places in the embodiment shown in FIG. 2, as long as they can prevent the displacement of the yoke 110, the number thereof is not limited (in a lock key shown in FIG. 3, the projecting portions 202 are provided at two places).

Figure 3:
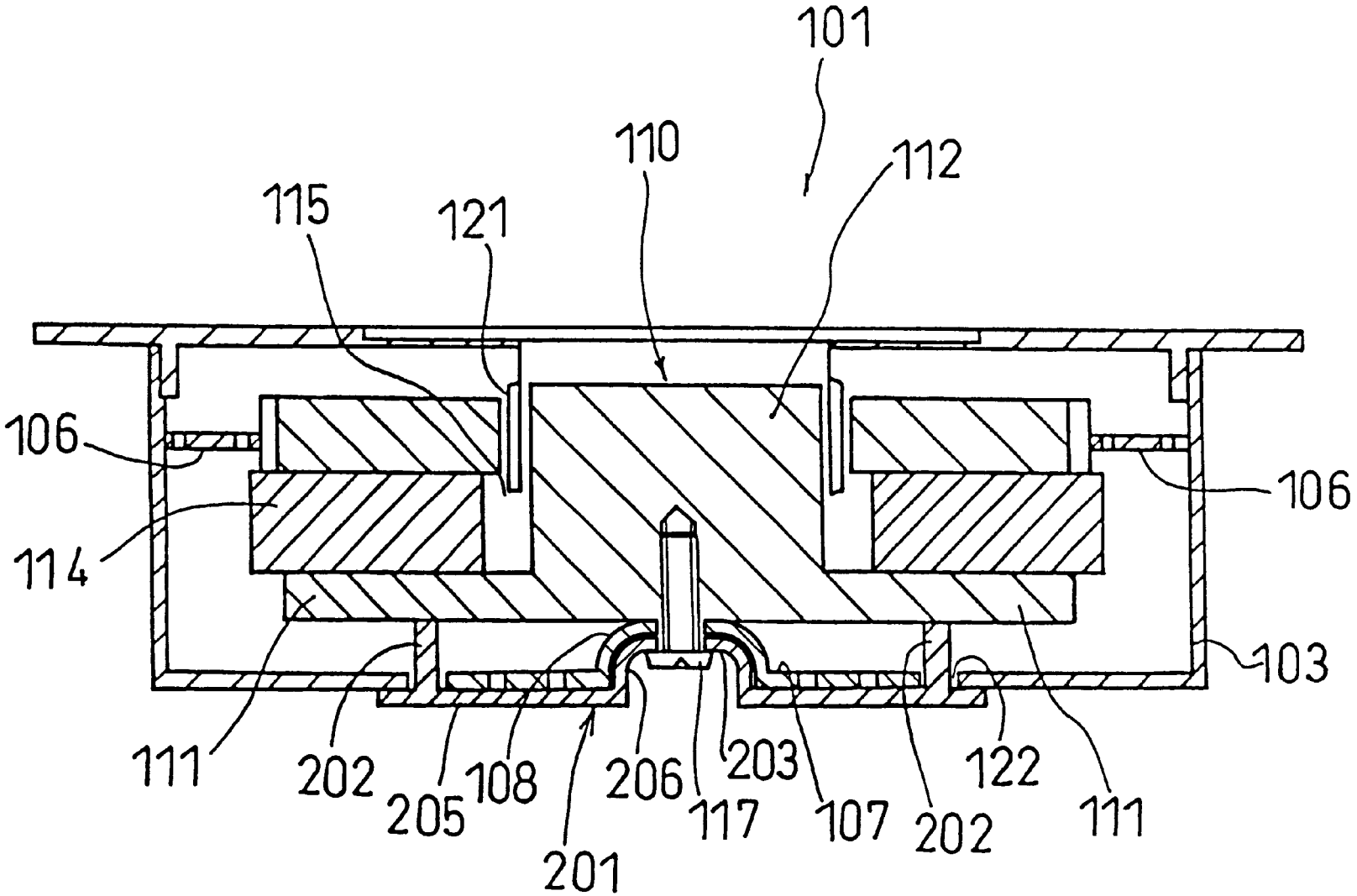
FIG. 3 is a sectional view showing a state of an example in which the lock key is installed to the electro-mechanical vibration transducer.

FIG. 3 is a sectional view of the electro-mechanical vibration transducer in the state where the lock key 201 is installed to the bottom portion of the case main body 101.

The lock key 201 is installed in such a manner that the convex portion 206 is fitted to the convex portion 108 of the case main body 101, the projecting portion 202 is inserted in the hole portion 122, and then, it is rotated in one direction (direction opposite to an arrow of "UNLOCK" in FIG. 2), so that a stepped portion 207 (see FIG. 2) of the projecting portion 202 is engaged with the frame 102 of the bottom portion of the case main body 101. Then, the lock key, together with the convex portion 108 engaged by the screw 117, is fixed to the yoke 110. At this time, it is desirable that the projecting portion 202 has a length to such a degree that its upper surface comes in contact with a lower surface of the bottom plate 111 of the yoke 110.

In this way, the displacement of the yoke 110 in the upper direction (direction of the frame 103) is prevented by a fixing effect of the screw 117, and the displacement in the down direction (direction of the frame 102) is prevented by the projecting portion 122 fitted into a space between the bottom plate 111 and the frame 102.

The installation of the lock key 201 is for reducing the load to the dampers 106 and 107 by vibration of the yoke 110 at the time of transportation of the electro-mechanical vibration transducer, and is removed at the time of normal use.

In the foregoing embodiment, although an electrodynamic transducer is shown as the electro-mechanical vibration transducer, it is needless to say that the same effect can be obtained also in the case of an electromagnetic electro-mechanical vibration transducer.

Figure 4B:
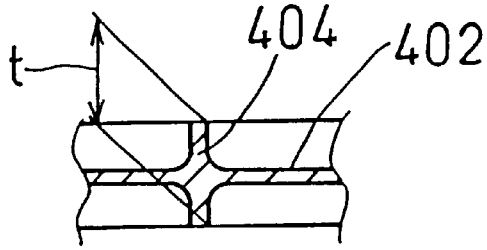
FIG. 4B is a sectional view of the damper shown in FIG. 4A and taken along line C—C.
Figure 4A:
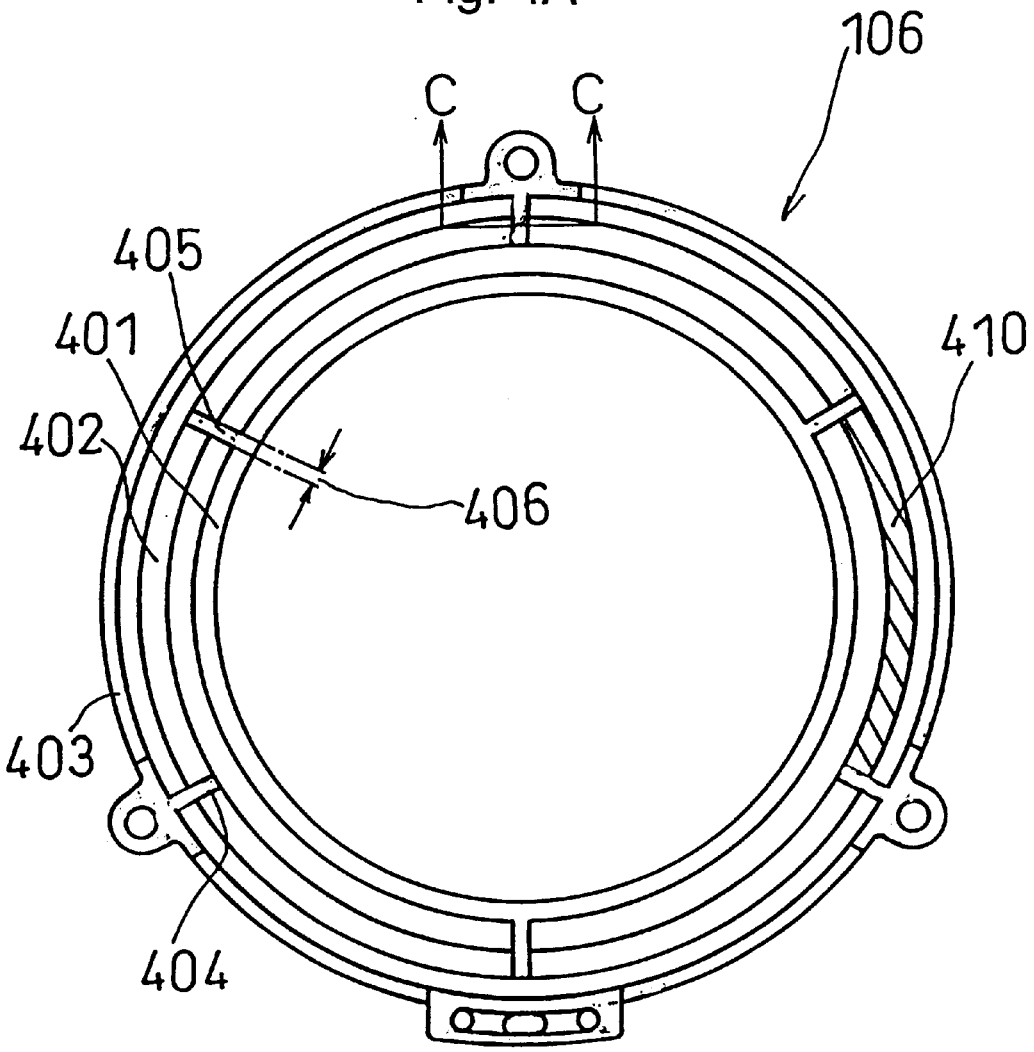
FIG. 4A is a plan view showing an example of a damper provided between a side surface of a case main body and a yoke.

FIG. 4A is a plan view of an example of the damper provided between the side surface of the case main body and the yoke, and FIG. 4B is a sectional view taken along line C—C of FIG. 4A.

As shown in the drawing, the damper 106 is made up of an annular inner damper 401, an intermediate damper 402, and an outer damper 403. The inner and intermediate annular dampers 401 and 402 are connected through an inside connecting portion 405, and the intermediate and outer annular dampers 402 and 403 are connected through an outside connecting portion 404. Besides, these dampers 401, 402, and 403 are concentrically disposed to each other. When they are provided in the electro-mechanical vibration transducer, the yoke supported in the case is fixed to the inner fringe of the inner damper 401, and the case and the outer damper 403 are fixed to each other.

As shown in FIG. 1, it is desirable that the damper 106 for supporting the yoke 101 is designed such that the freedom of the relative displacement of the yoke to the case frame is high in the up-and-down direction and the displacement is low in the right-and-left direction. For that purpose, for example, it is conceivable that the distance of a portion 410 between the adjacent connecting portions for supporting the dampers is made long.

In the embodiment shown in FIG. 4, the inner, intermediate, and outer dampers 401, 402, and 403, and the connecting portions 404 and 405 are made into one integrated structure. Besides, the connecting portions 404 and 405, which were not capable of being formed in the conventional damper obtained by boring an epoxy plate, are made to have a thickness of t, and such a structure is made that the intermediate damper 402 is connected crosswise to the thin plate connecting portion 404 extending from the outer damper 403 (see FIG. 4B). By making such a structure that the connecting portion has some thickness, it becomes possible to increase the strength against the weight of the supported yoke, and as a result, the width 406 of the connecting portions 404 and 405 can be made small, and the distance of the portion 410 between the adjacent connecting members can be made long.

Figure 5A:
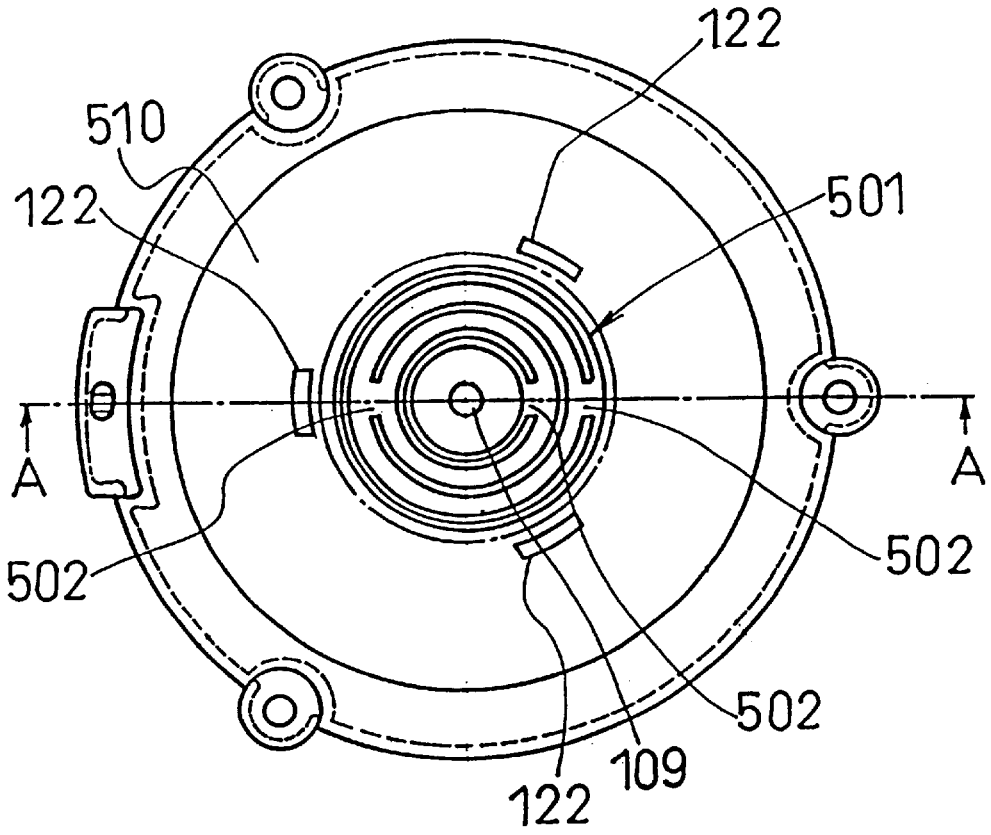
FIG. 5A is a plan view showing an example of a damper provided at a bottom portion of a case main body.

FIG. 5A is a plan view of an example of a damper provided at a bottom portion of an electro-mechanical vibration transducer.

As shown in the drawing, a damper 501 is provided at the center portion of a case frame 510 that corresponds to the frame 102 shown in FIG. 1 in such a manner that its outer peripheral portion is connected to the case frame 510, and the damper is screwed to a yoke in a main body through a screw hole 109 disposed at the center portion of the damper 501. The damper 501 is structured such that several annular dampers with different diameters are concentrically arranged, and the adjacent dampers are respectively connected to each other through one connecting portion 502. Additionally, the damper is connected to the case frame and the yoke so that the center of load of the case frame and the yoke is in coincidence with the center of the annular dampers to be connected thereto.

Figure 5B:
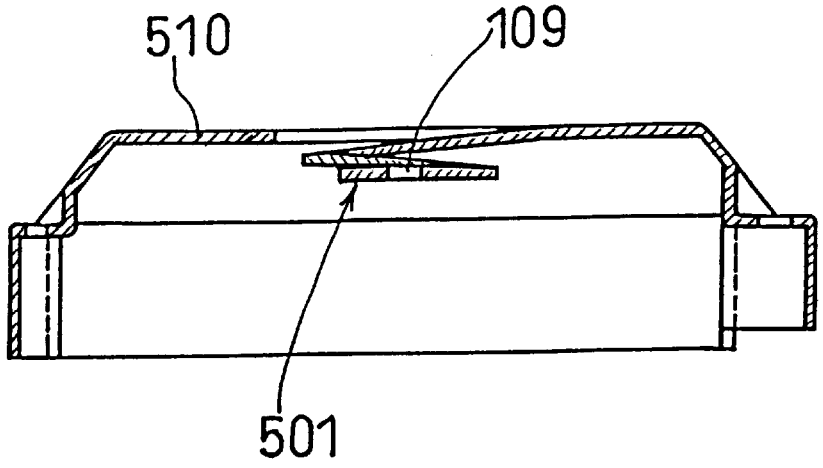
FIG. 5B is a sectional view of the damper provided at the bottom portion of the case main body shown in FIG. 5A and taken along line A—A.
Figure 6:
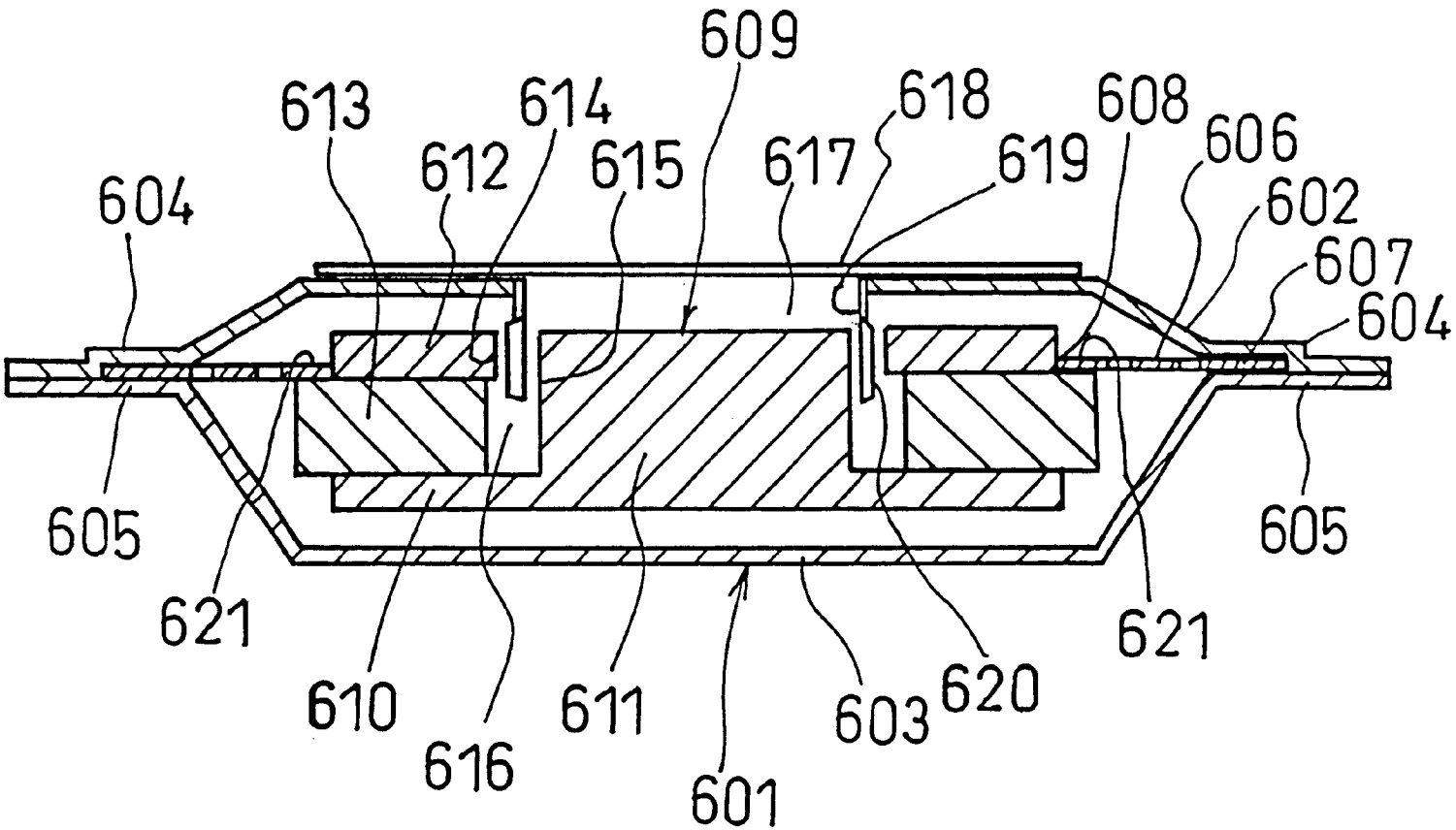
Fig. 6 Prior Art
FIG. 6 is a sectional view showing a structure of a conventional electro-mechanical vibration transducer.

FIG. 5B is a sectional view taken along line A—A of FIG. 5A.

As shown in the drawing, the damper 501 is structured such that a damper with a smaller diameter positioned inside among the concentrically arranged several annular dampers is positioned remote from the case frame 510. Even in the case where such a state occurs that the yoke screwed to the damper and supported in the case main body is displaced to the utmost so that the yoke surface comes in contact with the case frame 510, the damper with the small diameter positioned at the inside is accommodated inside of the damper with large diameter positioned at its outer peripheral portion, and its surface is not displaced beyond the outermost surface, that is, the surface of the case frame 510.

Incidentally, the damper of the present invention is not limited to the above example and can be made of a spiral shaped damper.

As described above, according to the first aspect of the invention, by installing the lock key, the projecting portion of the lock key is inserted between the yoke supported in the case main body and the case frame, and the relative displacement of the yoke to the case is prevented, so that it is possible to prevent the position of the yoke supported at a suitable position from being displaced. Since the load to the damper supporting the yoke at the time of transportation can be reduced, the material of the damper can be made soft, and the vibration of a heavy low sound influencing the performance of the electro-mechanical vibration transducer can be sufficiently obtained. Even in the case where the damper of the same material is used, its thickness, width, etc. can be suppressed, so that the size of the main body can be miniaturized.

According to the second aspect of the invention, the lock key can be installed by only screwing in such a manner that the projecting portion of the lock key is inserted in the hole portion of the main body, and the lock key is rotated so that the projecting portion and the case frame are engaged with each other, and removing is also easy. Thus, even in the case where there are many opportunities of movements, the work efficiency is not lowered.

According to the third aspect of the invention, such a structure is adopted that the connecting portion of the adjacent dampers is made to have a predetermined thickness, so that the strength of the damper can be increased. As a result, the width of the connecting portion can be made small and the distance between the adjacent connecting portions can be made long, so that it is possible to make the damper have flexibility and to increase the vibration efficiency.

According to the fourth aspect of the invention, when the yoke supported by the damper in the case main body is relatively displaced, the position of the damper surface displaced in accordance with the displacement can be made not higher than the position of the surface of the case main body, so that it is not necessary to consider a jut of the damper out of the frame. Thus, the shape of the case frame can be miniaturized.

What is claimed is:

1. An electro-mechanical vibration transducer, comprising:

a case main body;

a cylindrical frame;

a yoke having a top plate, a bottom plate, a magnetic pole and a magnetic gap being formed through the yoke;

a first damper fixed to the top plate through the cylindrical frame for supporting the yoke in the case main body;

a second damper having a convex portion attached to the bottom plate;

a coil positioned in the gap, the yoke and the case main body being relatively displaceable; and a lock key having a projection portion which fixes the lock key to the second damper so as to cover the second damper.

2. An electro-mechanical vibration transducer according to claim 1, wherein the lock key is detachable.

3. An electro-mechanical vibration transducer according to claim 1, wherein the first damper includes a plurality of annular dampers each having a different size, the annular dampers are concentrically provided, and the respective dampers are connected to each other through a thin plate connecting portion.

4. An electro-mechanical vibration transducer according to claim 1, wherein the projection portion provided on the lock key has a stepped portion to be inserted into a hole portion provided on the second damper so as to engage therewith by rotating in a locking direction.

5. An electro-mechanical vibration transducer according to claim 1, wherein the second damper is formed of a plurality of concentrically-made dampers in which each damper is connected at one portion to make a spring-like shape.

* * * * *